US006068360A

United States Patent [19]

Hiwada

[11] Patent Number: 6,068,360

[45] Date of Patent: May 30, 2000

[54] PRINTER HEAD DRIVE SYSTEM HAVING NEGATIVE FEEDBACK CONTROL

[75] Inventor: Shuhei Hiwada, Toyoake, Japan

[73] Assignee: Brother Kogyo Kabushiki Kaisha, Nagoya, Japan

[21] Appl. No.: 09/102,020

[22] Filed: Jun. 22, 1998

[30] Foreign Application Priority Data

| | | | |
|---|---|---|---|
| Jun. 30, 1997 | [JP] | Japan | 9-174263 |
| Jun. 30, 1997 | [JP] | Japan | 9-174264 |
| Jun. 30, 1997 | [JP] | Japan | 9-174265 |
| Jul. 1, 1997 | [JP] | Japan | 9-176234 |

[51] Int. Cl.[7] ..... B41J 2/01

[52] U.S. Cl. ..... 347/14; 347/9

[58] Field of Search ..... 347/9, 14, 19, 347/211

[56] References Cited

U.S. PATENT DOCUMENTS

| | | | |
|---|---|---|---|
| 4,560,998 | 12/1985 | Wimmer | 347/9 |
| 4,808,845 | 2/1989 | Suzuki et al. | 307/270 |
| 4,860,034 | 8/1989 | Watanabe et al. | 347/14 |
| 5,130,726 | 7/1992 | Fukushima et al. | 347/102 |
| 5,172,142 | 12/1992 | Watanabe et al. | 347/14 |

*Primary Examiner*—Joseph Hartary
*Assistant Examiner*—Craig A. Hallacher
*Attorney, Agent, or Firm*—Oliff & Berridge, PLC

[57] ABSTRACT

In a printer head drive system for a printing apparatus, both a voltage drop caused by power supply conductors connecting a power supply unit and a driver IC in a head unit and a voltage waveform distortion caused by a nonlinear input-output characteristics of the driver IC are compensated by a negative feedback control. In one aspect, voltage dividing resistors detect a voltage applied to the power supply input terminals of the driver IC and a constant voltage circuit regulates the voltage detected by the resistors to a reference voltage. In another aspect, a voltage applied to a dummy printer head is detected for the feedback control without voltage detecting resistors. A power amplifier in the power supply unit has a push-pull transistor circuit, and a series circuit of a resistor and a capacitor is connected in parallel with each base resistor. This arrangement improves responsiveness of the printing operation of the printer head which has a large electrostatic capacity.

20 Claims, 10 Drawing Sheets

PRINTER HEAD DRIVE SYSTEM HAVING NEGATIVE FEEDBACK CONTROL

CROSS REFERENCE TO RELATED APPLICATION

This application relates to and incorporates herein by reference Japanese Patent Applications No. 09-174263, No. 09-174264, No. 09-174265 and 09-176234, filed on Jun. 30, 1997, Jun. 30, 1997, Jun. 30, 1997 and Jul. 1, 1997, respectively.

BACKGROUND OF THE INVENTION

1. Field of the Invention

The present invention relates to a printer head drive system for a printing apparatus such as an ink-jet printer, and particularly to a printer head drive system for a printing apparatus in which a head unit and a power supply unit for supplying electric power to the head unit are connected by power supply conductors.

2. Description of Related Art

In a printer head drive system for a printing apparatus in which a head unit and a power supply unit for supplying electric power to the head unit are separately located away from each other, both of the units are connected by way of electric power supply conductors formed on a flexible printed circuit board (FPC).

In one drive system shown in FIG. 13, an ink jet type printer head 1 and a head driver IC (integrated circuit) 2 for electrically driving the printer head 1 are provided in a head unit 3. This head unit 3 is mounted on a carriage held movably for printing operation in the printing apparatus. A power supply unit 4 for supplying electric power to the driver IC 2 is provided on the fixed body of the printing apparatus. The driver IC 2 and the power supply unit 4 are connected by power supply conductors 5. The power supply unit 4 has a constant voltage source which comprises a power transistor 6 as a control element, voltage dividing resistors 7 for detecting an output voltage of the power supply unit 4, a reference voltage source 8 and an error detector 9 for controlling the power transistor 6. A control signal is supplied to the driver IC 2.

In this system, the printer head 1 may be a bubble jet type shown in FIG. 14 or may be a piezoelectric element (PZT) type. In case of the bubble jet type, each heater 11 is considered as a resistance member and is energized to generate a steam pressure for ink jetting operation.

In the above arrangement, electric power is supplied between output terminals a and b and an output voltage corresponding to a desired voltage of the reference voltage source 8 is generated between terminals c and d by the power transistor 6. Here, the voltage dividing resistors 7, reference voltage source 8 and error detector 9 provides a negative feedback control. The electric power thus controlled is supplied between terminals e and f serving as power input terminals of the driver IC 2 through the power supply conductors 5. The driver IC 2 selectively supplies the electric power supplied from the power supply unit 4 to individual driving elements within the printer head 1 in response to the inputted control signal.

In another control system shown in FIG. 15, the power supply unit 4 comprises a power amplifier 41 and a pulse generator 42 but has no feedback control. The head unit 3 may be the bubble jet type or the PZT type shown in FIG. 16. In case of the PZT type in which the pressure within ink channels are changed for ink jetting operation, each PZT is considered to be a capacitance member 12.

In either system, the power supply conductors 5 for supplying the electric power from the output terminals c and d of the power supply unit (fixed side) 4 to the head unit (movable side) 3 includes a resistance (R) and an inductance (L) as shown by dotted lines. Although R and L are shown between terminals c and e and terminals d and f in FIG. 13, in a lumped constant manner, R and L exist actually along the length of each conductor in a distributed constant manner.

When ink is to be jetted simultaneously from a number of nozzles, electric current flows to a plurality of channels simultaneously, and power source current is expressed as follows.

$I=V\cdot N/Rh$: in the case of using heaters 11, wherein I, V, N and Rh represent power source current, power source voltage, number of simultaneously-driven ink jet nozzles and nozzle resistance value (heater resistance), respectively.

$I=V\cdot N/Ron$: in the case of using PZTs 12, wherein I, V, N, and Ron represent power source current, power source voltage, number of simultaneously-driven ink jet nozzles nozzle resistance value (on-resistance of a switch in the driver IC), respectively.

Assuming that the current per nozzle is 20 mA and that there are 128 channels in the printer head 1, then the total current is 2.56 A. Further, assuming that the resistance value of each conductor strip in the power supply conductors 5 is 1Ω, then the resistance value of the supply and return conductive strips of the power supply conductors 5 is 2Ω. Thus, the voltage drop in the power supply conductors 5 is 5.12 V. The voltage supplied actually to the terminals decreases as shown by the dotted line in FIG. 17. This voltage drop caused by the power supply conductors 5 is not negligible relative to the power source voltage (e.g., 24 V). As a result, the electric power that should be applied to the printer head 1 is consumed wastefully by the power supply conductors 5.

Further, since the power supply conductors 5 include inductance as well as resistance, the sharp rising and falling of the voltage applied to the driver IC are lessened as shown by dotted line in FIG. 18.

Still further, since the input-output characteristics of the driver IC 2 is nonlinear, a head drive signal is distorted further. More specifically, the driver IC 2 which is typically C-MOS analog switches has a non-linear switch resistance versus input voltage characteristics as shown in FIG. 19. The analog switch has a function to turn on/off the input and output in response to the control signal. Due to its nonlinear characteristics, the input and output resistance provided when the switch is turned on is changed relative to the input voltage. Therefore, as shown in FIG. 20, as compared with the output from the pulse generator 42, a large delay occurs in the leading edge and the trailing edge of the output from the driver IC 2. Thus, it frequently occurs that the printer head 1 cannot demonstrate its intended ink jet ability fully. That is, an ink-jet speed is lowered lowering a printing quality.

To reduce the loss occurring in the power supply conductors 5, the width of the conductor strip be increased in order to lower the impedance of the power supply conductors 5. Further, a capacitor 10 of large capacity and a capacitor of low impedance should be disposed near the driver IC 2. Those additional circuit elements will cause the control system to become large-sized and expensive.

SUMMARY OF THE INVENTION

It is an object of the present invention to provide a printer head drive system for a printer apparatus in which a voltage drop generated by power supply conductors between a head unit and a power supply unit can be compensated for by a negative feedback control.

According to one aspect of the present invention, a negative-feedback control loop is provided by the use of voltage dividing resistors. The voltage dividing resistors detects an output voltage of a power supply unit at a point where power supply input terminals of a head unit are provided. Thus, even when a voltage drop occurs in power supply conductors, the power supply unit is enabled to supply a compensated constant voltage to the head unit. Accordingly, the printer head can be properly operated without being affected by the voltage drop in the conductive wiring material.

According another aspect of the present invention, a negative-feedback control loop is provided without voltage dividing resistors. A voltage applied across one ink jet channel such as a heater or piezoelectric element in a printer head is detected and applied to a power supply unit for the feedback control.

Preferably, the final stage of a power amplifier in the power supply unit, i.e., transistors to which a driver IC is connected through power supply conductors, is connected in the push-pull circuit configuration for a load of a capacitive type. Thus, particularly when the transistors are turned off, the base-emitter potential of the transistors rapidly follow the output of the preceding stage. A series circuit of a resistor and a capacitor is connected in parallel with each base resistor of the transistors.

BRIEF DESCRIPTION OF THE DRAWINGS

Other objects, features and advantages of the present invention will become more apparent from the following detailed description made with reference to the accompanying drawings, in which the same or like reference numerals are used to designate the same or like circuit parts. In the drawings.

DETAILED DESCRIPTION OF THE PREFERRED EMBODIMENTS

First Embodiment

Figure 1:
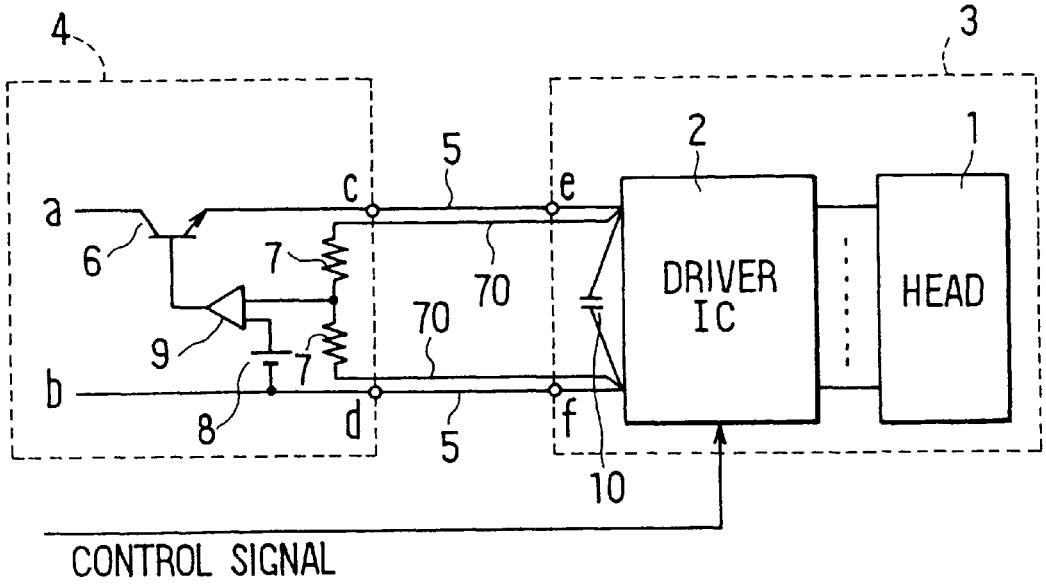
FIG. 1 is a circuit diagram showing a printer head drive system according to a first embodiment of the present invention.

In a first embodiment shown in FIG. 1, a printer head drive system has a head unit 3, which comprises a printer head 1 and a driver IC 2 (integrated circuit of analog switches) for electrically driving the printer head 1 for ink jet printing. The driver IC 2 receives a control signal to select specific ink jet channels in the printer head 1. A capacitor 10 is connected to the input side of the driver IC 2. The control system further has a power supply unit 4 for supplying an electric power to the driver IC 2. The head unit 3 is mounted on a carriage which is moved for a printing operation, while the power supply unit 4 is disposed fixedly on an apparatus body. Thus, two units 3 and 4, are connected electrically through power supply conductors 5 formed as an FPC (flexible printed circuit board) having conductive strips for a power supply and a control signal supply.

The power supply unit 4 comprises a power transistor 6 for amplifying an input pulse voltage applied to input terminals a, b, voltage dividing resistors 7 for detecting a voltage applied to input terminals e, f of the head unit 3, a reference voltage source 8 and an error detector 9. The voltage dividing resistors 7 are connected to the driver IC 2 through signal conductors 70 provided along with the power supply conductors 5 on the FPC. The signal conductors 70 for the voltage dividing resistors 7 are led out from the input side of the driver IC 2. The error detector 9 is constructed as a differential amplifier. It compares the voltage detected by the voltage detecting resistors 7 with the reference voltage of the reference voltage source 8 and feedback-controls the power transistor 6, so that the output voltage applied to the driver IC 2 is controlled to the reference voltage. Thus, the power supply unit 4 operates as a constant voltage circuit for outputting a constant voltage.

As both ends of the voltage dividing resistors 7 for detecting the output voltage of the power supply unit 4 are connected not to power supply output terminals c, d of the power supply unit 4 but to near the power supply input terminals e, f of the head unit 3, the detected voltage contains a voltage drop caused by the power supply conductors 5. Thus, the power supply conductors 5 provides a part of the negative feedback control loop.

Figure 2:
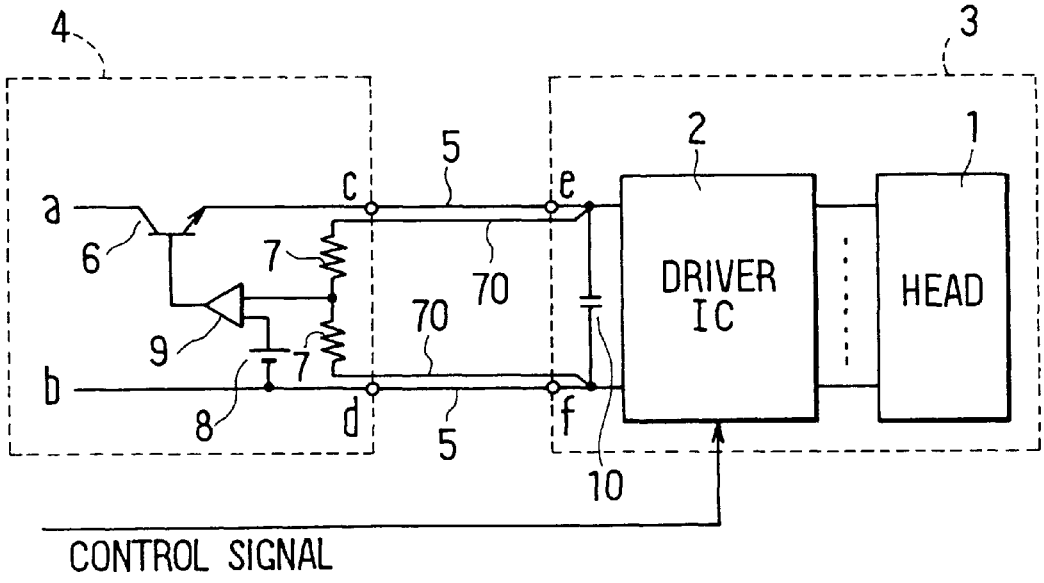
FIG. 2 is a circuit diagram showing a printer head drive system according to a modification of the first embodiment.
Figure 3:
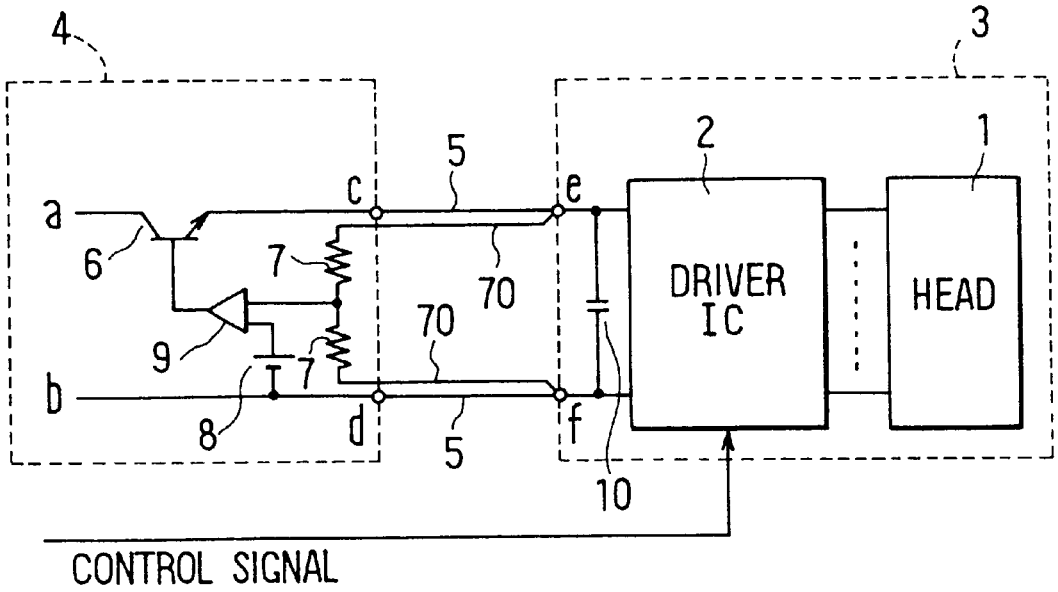
FIG. 3 is a circuit diagram showing a printer head drive system according to another modification of the first embodiment.
Figure 4:
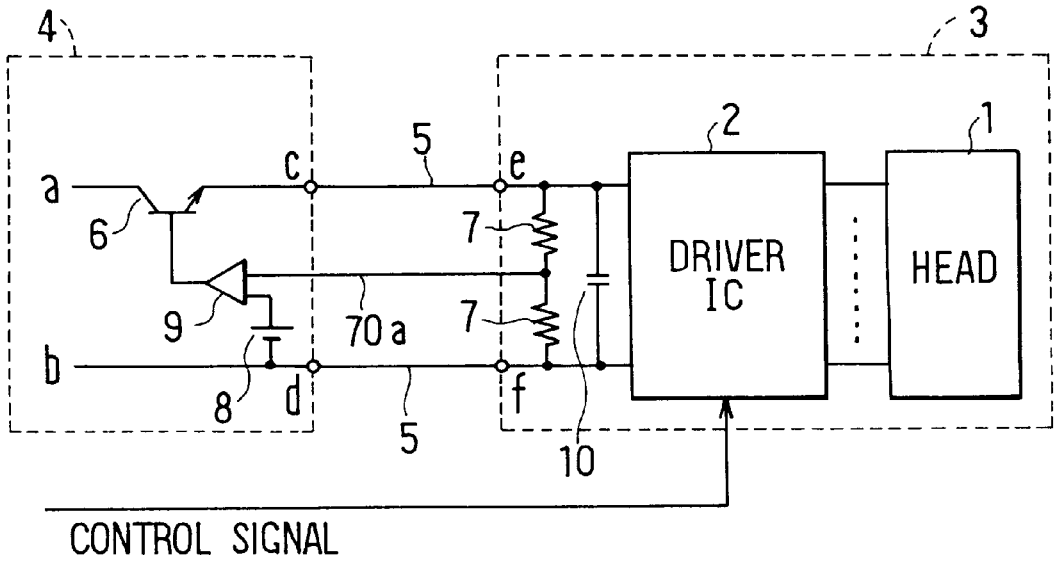
FIG. 4 is a circuit diagram showing a printer head drive system according to a further modification of the first embodiment.

As modifications of the first embodiment, the signal conductors 70 are led out from nearby portions across the capacitor 10 as shown in FIG. 2, while the signal conductors 70 are led out from the power supply input terminals e, f of the head unit 3 as shown in FIG. 3. Further, as shown in FIG. 4, the voltage dividing resistors 7 are disposed within the head unit 3, and a signal conductor 70*a* is led out from a voltage dividing point of the voltage dividing resistors 7. These signal conductors 70, 70*a* may be provided on the FPC of the power supply conductors 5.

In each control system, the output voltage supplied from the output terminals c, d of the power supply unit 4 is detected by the voltage dividing resistors 7 which detect the voltage near the power supply input terminals e, f of the driver IC 2. Thus, even when a voltage drop is caused by the power supply conductors 5, the power supply unit 4 is able to supply the required constant voltage. Thus, the voltage drop in the power supply conductors 5 can be compensated. Accordingly, the printer head 1 can be properly operated without being affected by the voltage drop in the power supply conductors 5. Therefore, the width of the conductor of the power supply conductors 5 need not be increased so much, and the capacitor 10 of large capacity can be eliminated if desired.

Further, the power supply conductors 5 should preferably be as thin as possible to provide flexibility. In this case, although the impedance of the power supply conductors 5 increases to cause a larger voltage drop, such voltage drop can be compensated by the negative feedback control. Hence, no trouble occurs in the normal operation of the printer head 1 and a high printing quality may be guaranteed.

Further, although the signal conductors 70 of the voltage dividing resistors 7 and the signal conductor 71 are led out from the driver IC 2 to the power supply unit 4 through a certain length, only a very small current (as compared with a current flowing to the power supply conductors 5) flows through the signal conductors 70, 71 because the resistance value of the voltage dividing resistors 7 is large enough. Hence, a voltage drop caused in those signal conductors can be neglected. Moreover, in the modification shown in FIG. 4, since the voltage dividing resistors 7 are disposed in the head unit 3, the setting of the voltage dividing point can be varied in accordance with the type of the printer head 1.

Further, when the printer head 1 is a piezoelectric element type, a voltage change tends to be delayed due to the capacitor component of the piezoelectric element. However, since the voltage drop is compensated, it is possible to suppress the delay in rising and falling change of the voltage. Thus, responsiveness of the ink jet operation of the printer head 1 can be improved.

Furthermore, when the printer head 1 is a heater type which generates steam by a heater to jet droplets of ink, a thermal head or a heat sublimation type head, a heater energizing current is large causing a larger voltage drop in the power supply conductors 5. In this case, such a large voltage drop can be compensated as well.

Second Embodiment

Figure 5:
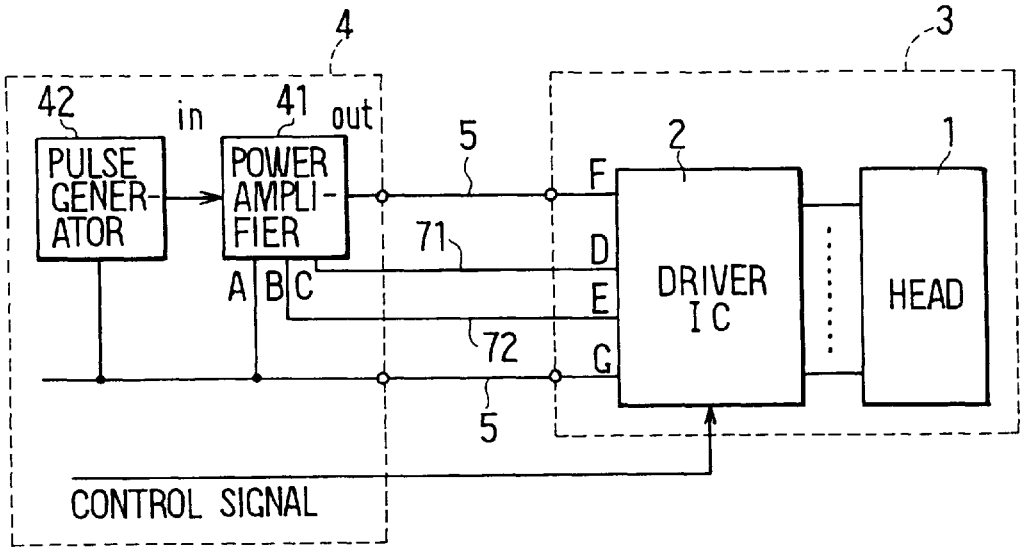
FIG. 5 is a circuit diagram of a printer head drive system according to a second embodiment of the present invention.

In a second embodiment shown in FIG. 5 also, a printer head drive system comprises a head unit 3 including a printer head 1 and a driver IC (integrated circuit of analog switches) 2. The system further comprises a power supply unit 4 including a power amplifier 41 and a pulse voltage generator 42. The head unit 3 is connected movably to the power supply unit 4 through power supply conductors 5 provided on a flexible member such as an FPC. Input terminals F, G (power ground) of the head unit 3 are connected to output terminals of the power amplifier 41 through the power supply power supply conductors 5.

Figure 6:
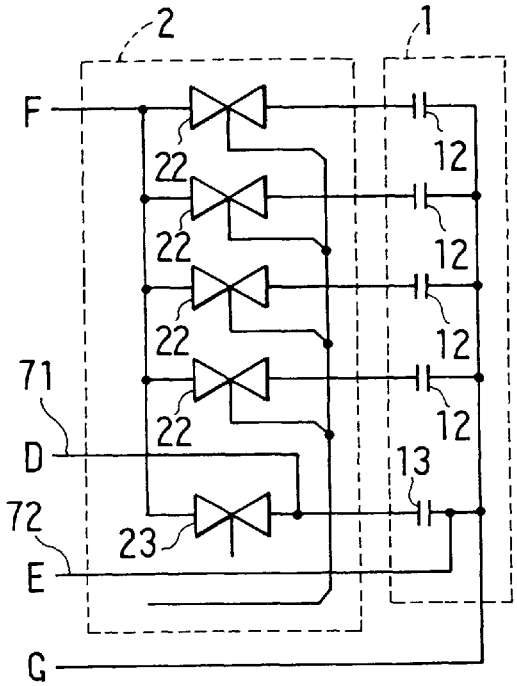
FIG. 6 is a circuit diagram of a driver IC used in the second embodiment.

The power amplifier 41 includes a negative feedback circuit, in which signal conductors 71, 72 are led out from the head unit 3. As shown in FIG. 6, the printer head 1 is a piezoelectric element (PZT) type and a PZT 12 for each channel is represented as a capacitor. The driver IC 2 is constructed by analog switches 22 which are turned on and off by the control signal to supply and interrupt the voltage of a terminal F to corresponding PZT 12. An additional set of normally-on analog switch 23 and a dummy PZT 13 are connected to the analog switches 22 and PZTs 12. The PZT 13 may be replaced with a capacitor having an equivalent electrostatic capacity. The signal conductor 71 connected to a terminal D is led out from a connection point between the normally-on switch 23 in the driver IC 2 and the dummy head (PZT) 13, while the signal conductor 72 connected to a terminal E is led out from the ground point (G) of the PZTs 12, 13. These signal conductors 71 and 72 are connected to terminals C and B of the power amplifier 41 (FIG. 5), respectively, for a negative feedback of a voltage applied to the dummy printer head 13.

Figure 7A:
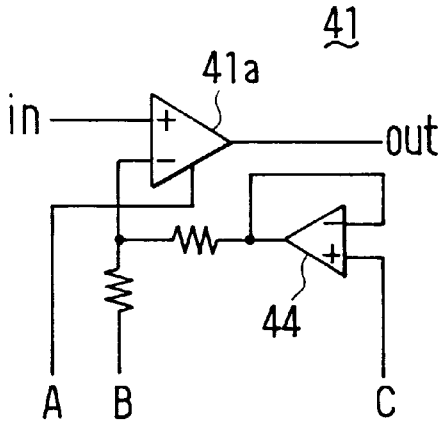
FIGS. 7A and 7B are circuit diagrams of a power amplifier used in the second embodiment.
Figure 7B:
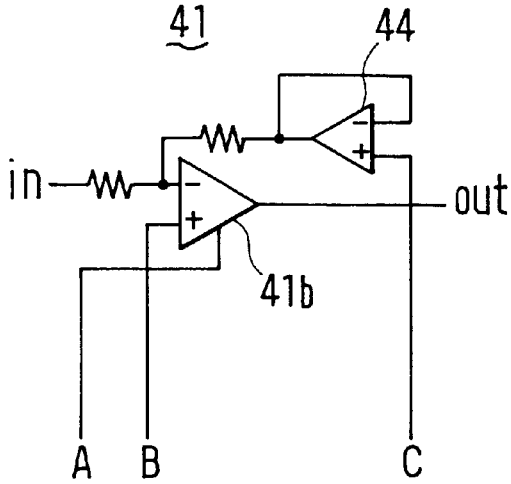

The power amplifier 41 having a negative feedback circuit may be constructed as shown in FIG. 7A or 7B. That is, the amplifier 41 may be a non-inverting type amplifier 41*a* shown in FIG. 7A or an inverting type amplifier 41*b* shown in FIG. 7B. The non-inverting amplifier 41*a* and the inverting amplifier 41*b* both operates as a voltage follower in such a manner that a difference between its input voltage and output voltage is eliminated. However, the input voltage and the output voltage are inverted in the case of the inverting amplifier 41*b*. For the negative feedback control, an impedance converter 44 is connected in the negative feedback loop of each amplifier 41*a*, 41*b*. The impedance converter 44 has a low output impedance and a high input impedance. Therefore, regardless of the fact that the load of the power amplifier 41 is the driver IC 2 having a nonlinear input-output characteristics and the electrostatic capacity, an electric current that should flow to the load is restricted from flowing to the negative feedback circuit.

Figure 8:
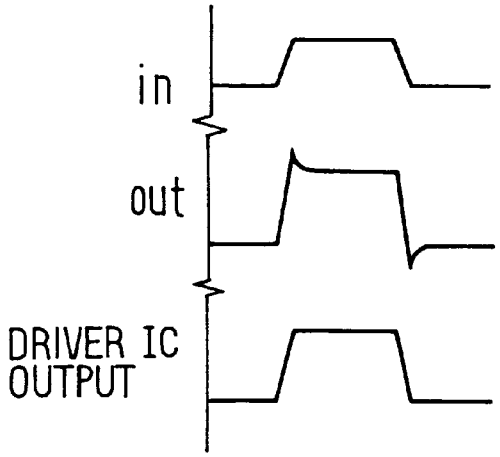
FIG. 8 is a chart showing waveforms of voltages developed in the power amplifier and the driver IC.

As the power amplifier 41 includes the driver IC 2 in its negative feedback loop, the occurrence of the voltage waveform distortion caused by the nonlinear characteristic of the analog switch 22 of the driver IC 2 can be minimized by the negative feedback control. That is, as shown in FIG. 8, although the power amplifier 41 tends to produce a distorted pulse voltage (out) in response to the pulse voltage (in) applied from the pulse generator 42 because of the nonlinear characteristics of the driver IC 2 and capacitance component of the PZT 12, this waveform distortion can be compensated by the negative feedback and the driver IC 2 is enabled to produce the pulse voltage which is linear to the amplifier input voltage (in). Thus, the printer head 1 can be operated as defined by the pulse voltage of the pulse voltage generator 42.

Figure 9:
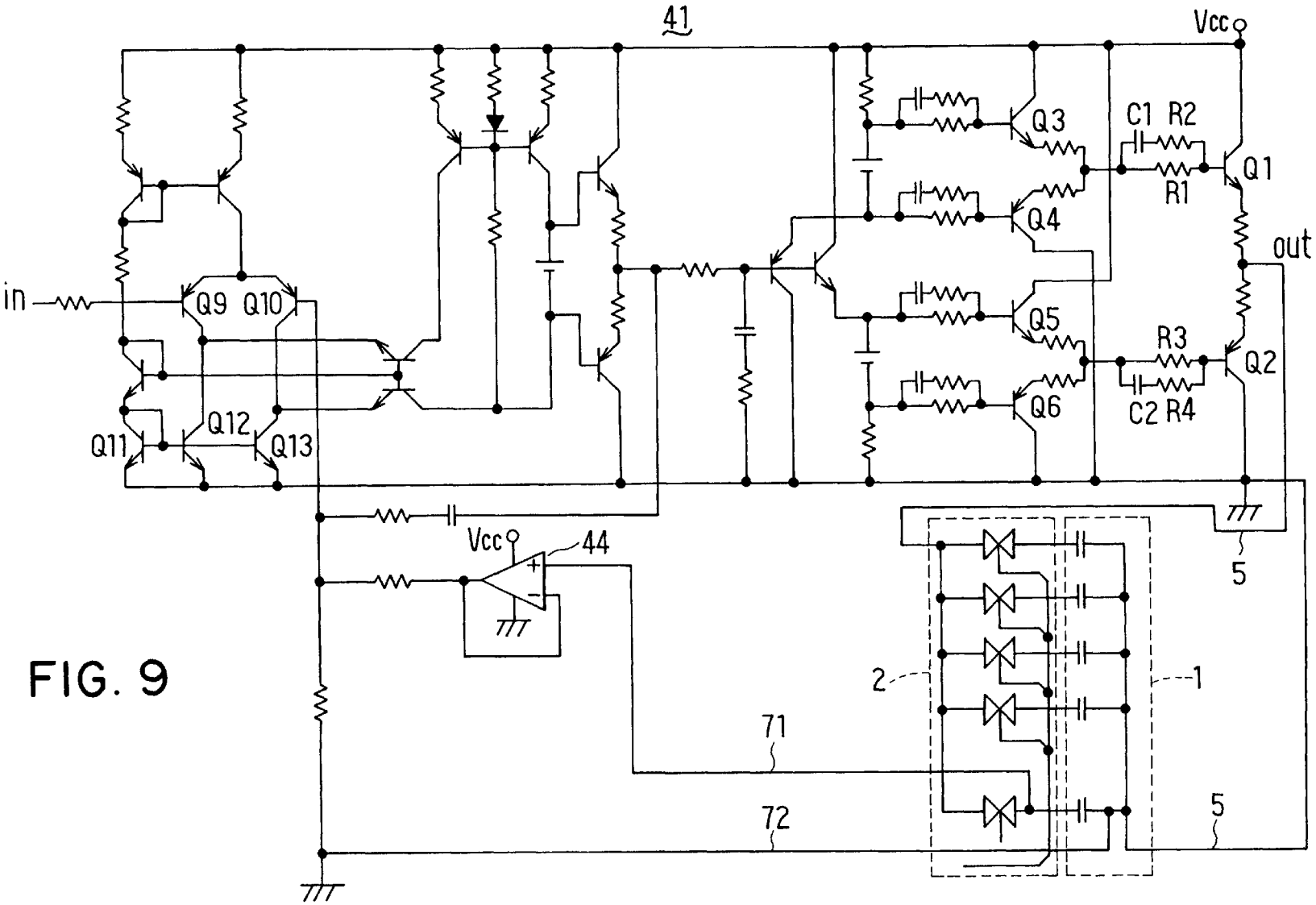
FIG. 9 is a detailed circuit diagram of the printer head drive system according to the second embodiment.

In actual practice, the power amplifier 41 is constructed as shown in detail in FIG. 9 in which the printer head 1 and the driver IC 2 are also shown.

First, the power amplifier 41 has a buffer stage (current amplifying stage) as its final stage. Transistors Q1, Q2 at the final stage of the power amplifier 41 constitute a push-pull circuit. This push-pull circuit is different from the normal one in that a series circuit of a resistor R2 and a capacitor C1 are connected in parallel with the base resistor R1 of the transistor Q1, and a series circuit of a resistor R4 and a capacitor C2 are connected in parallel with the base resistor R3 of the transistor Q2. The transistors Q1, Q2 are connected through the power supply conductors 5 to the driver IC 2. As the load of this driver IC 2 is the printer head 1 which is a large electrostatic capacity, the push-pull operation of the transistors Q1, Q2 becomes equivalent to the switching operation in the transient region of the printer head driving voltage. Thus, the base-emitter potential of the transistors Q1, Q2 rapidly follows the output of the preceding stage particularly when the transistors Q1, Q2 are turned Off. Because, although the base resistances of the transistors Q1, Q2 are defined only by the resistors R1, R3 in the normal state, the base resistances of the transistors Q1, Q2 are defined by parallel resistors of the resistors R1, R2 in the transient region.

Transistors Q3, Q4 and transistors Q5, Q6 constitute a circuit portion which respectively drive the transistors Q1 and Q2. These transistors also constitute a push-pull circuit. Generally, this push-pull circuit is operated in the manner of Darlington connection or emitter-follower, and is not operated in a push-pull fashion. A series circuit of a resistor and a capacitor is also connected in parallel with the base resistor of each transistor. These transistors Q3, Q4, Q5, Q6 are operated in a push-pull fashion and the series circuit of the resistor and capacitor are connected for the same reason as for the transistors Q1, Q2.

Figure 10:
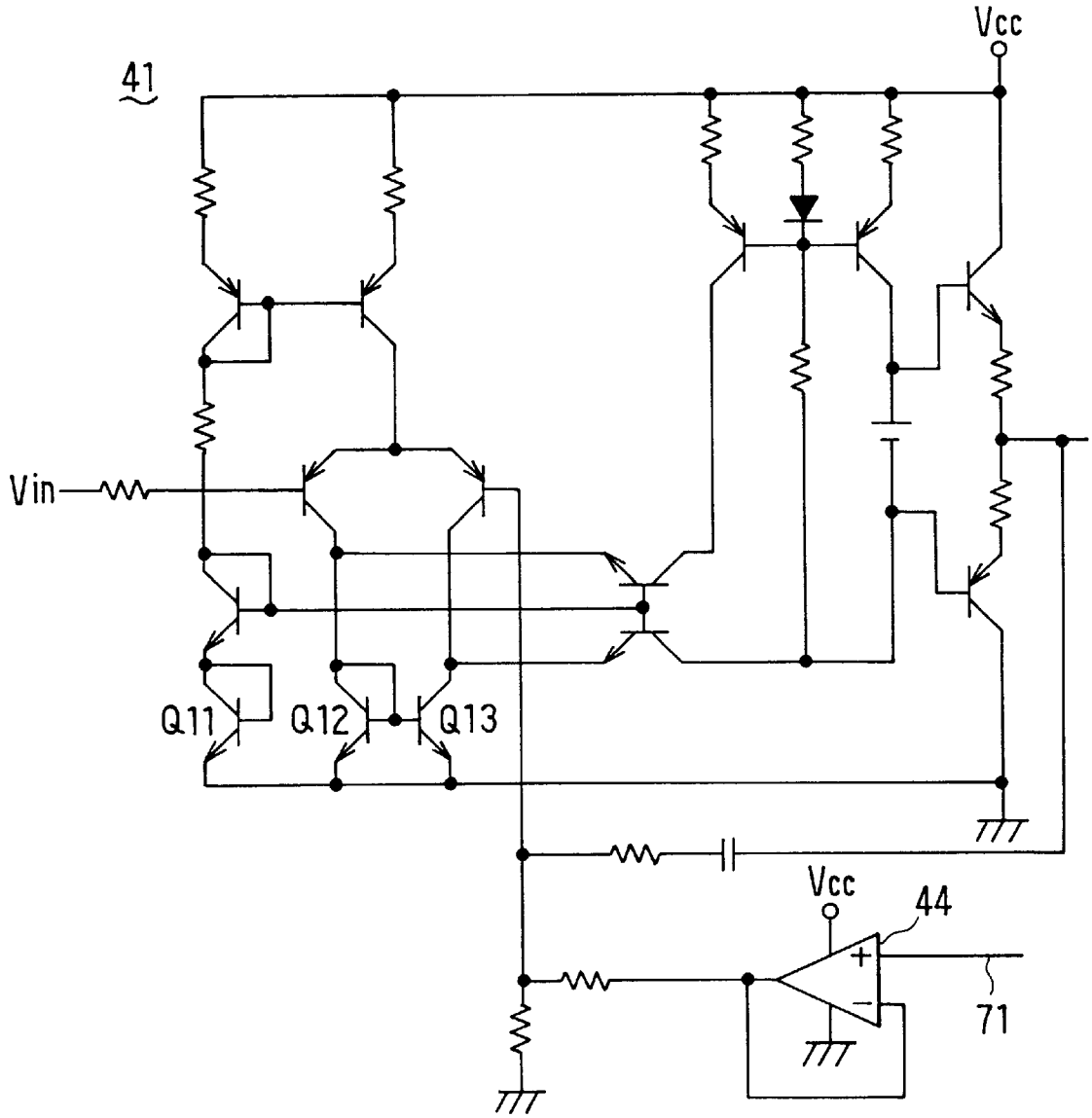
FIG. 10 is a circuit diagram of the power amplifier according to a modification of the second embodiment.

The power amplifier 41 has a voltage amplifying stage at its input stage (in). Input transistors Q9, Q10 of the voltage amplifying stage constitute a differential amplifying circuit which operates as an error detector to reduce a difference between the feedback voltage from the signal conductors 71, 72 and the input voltage (in) applied from the pulse voltage generator 42. As a collector load, there is used a constant current source comprising transistors Q11, Q12, Q13. Alternatively, as shown in FIG. 10, a current-mirror circuit comprising transistors Q12, Q13 may be used. Since the voltage drop between the collectors of the input transistors Q9, Q10 and the ground becomes the output voltage, this voltage drop should be suppressed to a minimum. The constant current source or the current-mirror circuit reduces the voltage drop.

As the input transistors Q9, Q10 of the voltage amplifying stage, PNP transistors should be used in the case of the positive single voltage source, while NPN transistors should be used in the case of the negative single voltage source. It is understood that the printer head 1 is less likely to deteriorate when driven by a voltage the amplitude of which changes at around 0 volt (V). In particular, in the case of the piezoelectric element, a polarization tends to occur when the voltage is continuously applied. For those reasons, it is necessary for the input transistors Q9, Q10 of the voltage amplifying stage to provide collector output voltages changing from about 0 volt (V). In this case, according to the above arrangement, the voltage drop between the collector and the ground can be reduced so that the above requirements may be satisfied.

Figure 11:
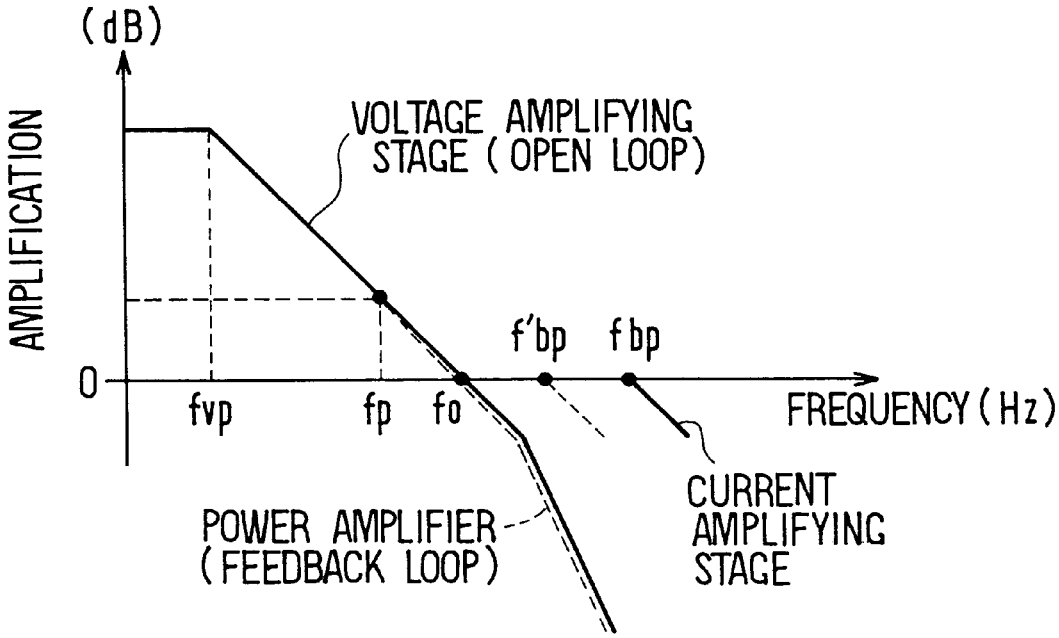
FIG. 11 is a characteristic graph showing a relationship between an amplification degree and frequencies of a power amplifying stage and a current amplifying stage in the second embodiment.

As shown in FIG. 11 showing the operational characteristics between the voltage amplifying stage and the amplification degree relative to the frequency of the current amplifying stage, a first cut-off frequency fbp of the current amplifying stage is set to be larger than a frequency fo at which the amplification degree of the voltage amplifying stage becomes 0. When the load of the power amplifier 41 is a large electrostatic capacity like a PZT, its capacity is changed considerably and there are less ink-jet channels, i.e., when the electrostatic capacity as the load is small, the cut-off frequency fbp determined by the output impedance of the power amplifier 41 and the load electrostatic capacity is sufficiently large. On the other hand, when there are many ink-jet channels, i.e., when the electrostatic capacity as the load is large, the cut-off frequency fbp becomes small and close to the frequency fo at which the amplification degree of the voltage amplifying stage becomes 0. Even in that case, according to the above arrangement, a stable operation can be obtained even when the negative feedback is effected on the power amplifier 41.

Figure 12A:
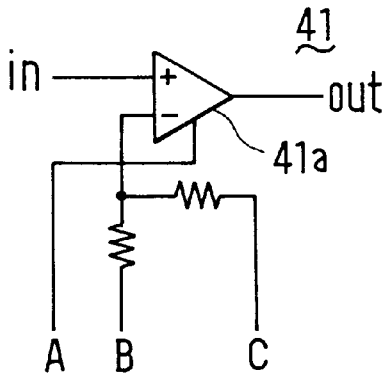
FIGS. 12A and 12B are circuit diagrams of the power amplifier according to another modification of the second embodiment.
Figure 12B:
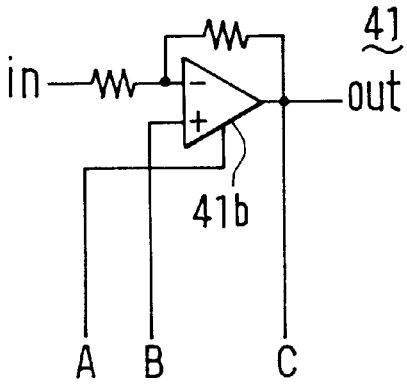
Figure 13:
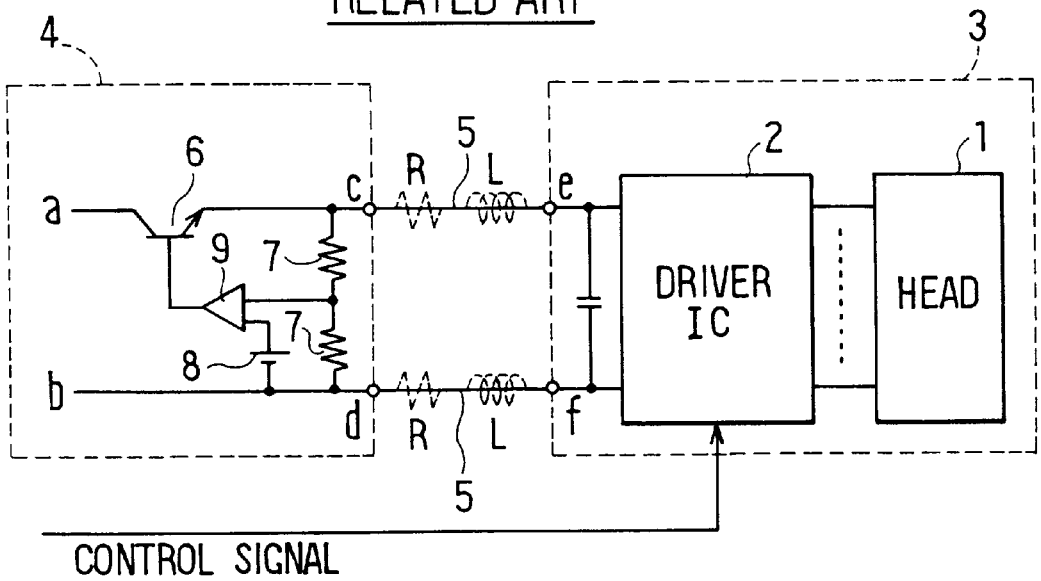
FIG. 13 RELATED ART
FIG. 13 is a circuit diagram of a printer head drive system according to one related art.
Figure 14:
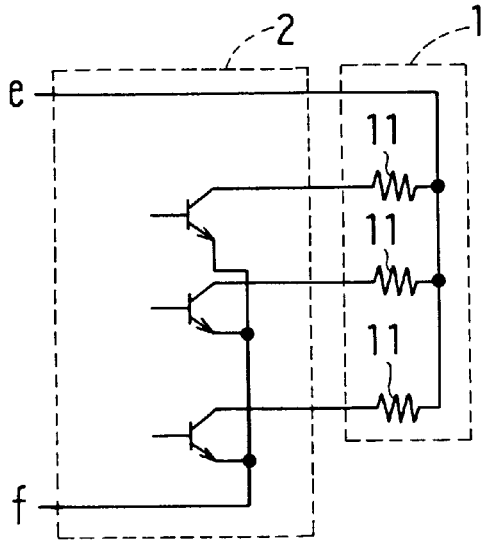
FIG. 14 RELATED ART
FIG. 14 is a circuit diagram of a bubble jet type head unit used in the related art.
Figure 15:
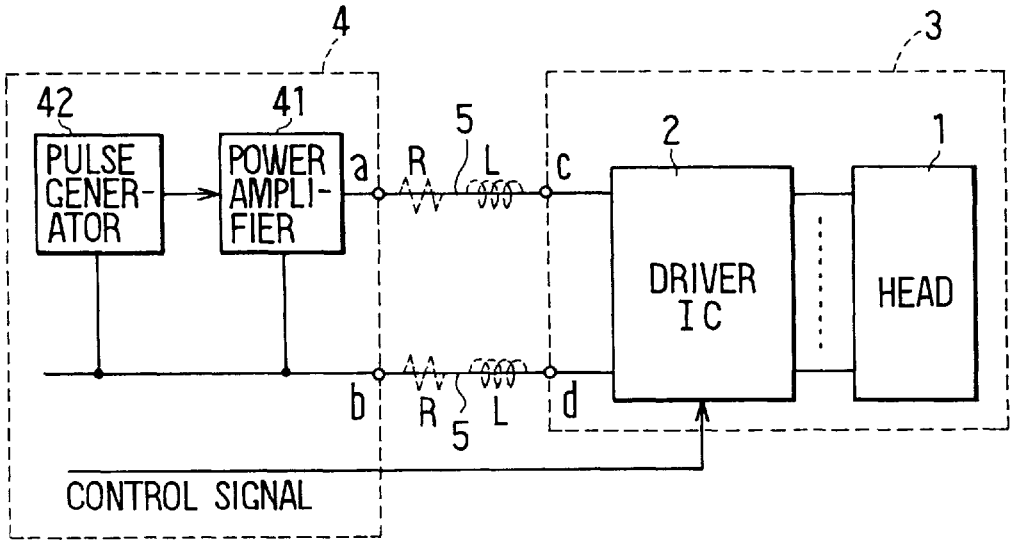
FIG. 15 RELATED ART
FIG. 15 is a circuit diagram of a printer head drive system according to another related art.
Figure 16:
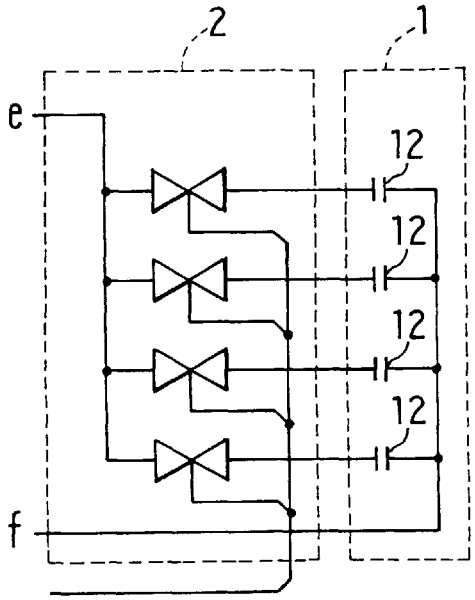
FIG. 16 RELATED ART
FIG. 16 is a circuit diagram of a PZT type head unit used in the another related art.
Figure 17:
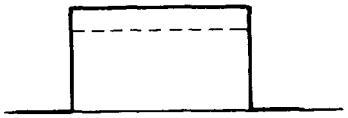
FIG. 17 RELATED ART
FIG. 17 is a waveform chart showing a voltage change in a drive voltage applied to the head unit in the related art.
Figure 18:
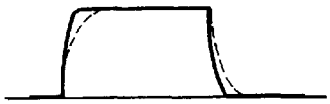
FIG. 18 RELATED ART
FIG. 18 is waveform chart showing an edge change in the drive voltage applied to the head unit in the related art.
Figure 19:
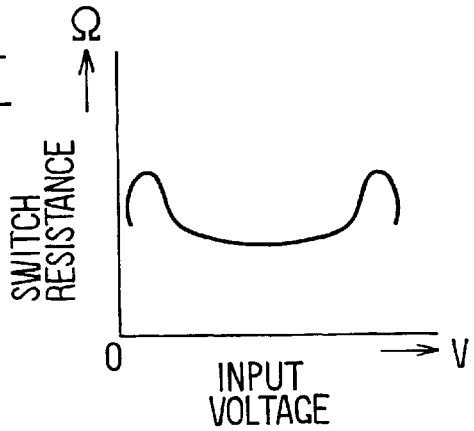
FIG. 19 RELATED ART
FIG. 19 is a graph showing a nonlinear characteristic of a driver IC used in the related art.
Figure 20:
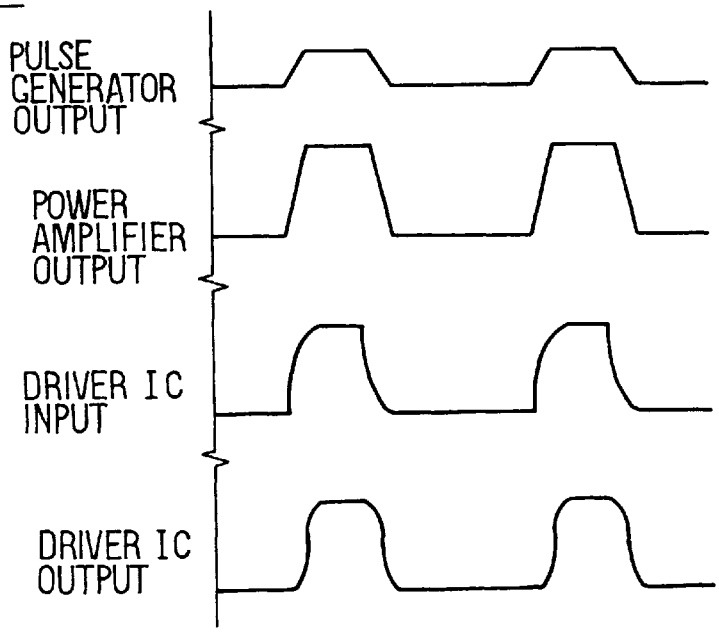
FIG. 20 RELATED ART
FIG. 20 is a waveform chart showing changes in voltages in a pulse generator, power amplifier and driver IC used in the related art.

The power amplifier 41 in the second embodiment may be simplified to have no impedance converter as shown in FIGS. 12A and 12B, as opposed to the circuit construction shown in FIGS. 7A and 7B.

The second embodiment and its modifications provide the same or similar advantages as the first embodiment described above.

The present invention is not limited to those disclosed embodiments and modifications and that various changes and further modifications could be effected.

I claim:

1. A printer head drive system for a printing apparatus comprising:

a head unit electrically driven for printing by an electric power supplied to power supply input terminals thereof;

a power supply unit provided away from the head unit for supplying the electric power to the head unit, the power supply unit including a constant voltage circuit for regulating a voltage of the electric power to a reference voltage;

power supply conductors connecting the head unit and the power supply unit; and a voltage detecting circuit connected to the power supply input terminals of the head unit for detecting the voltage of the power supply unit and applying the detected voltage to the constant voltage circuit for a negative feedback control.

2. The printer head drive system as in claim 1, wherein:

the head unit is held away and movably from the power supply unit; and the power supply conductors are flexible.

3. The printer head drive system as in claim 2, wherein:

the voltage detecting circuit includes voltage dividing resistors provided in the power supply unit; and signal conductors connect the power supply input terminals of the head unit to the voltage dividing resistors.

4. The printer head drive system as in claim 2, wherein:

the voltage detecting circuit includes voltage dividing resistors provided in the head unit; and a signal conductor connects a junction of the voltage detecting resistors to the constant voltage circuit in the head unit.

5. The printer head drive system as in claim 1, wherein:

the head unit includes an ink jet head which is one of a piezoelectric element type and a steam generating heater type for ink jet operation.

6. A printer head drive system for a printing apparatus comprising:

a switch circuit for selectively driving head channels when driven by an electric power supplied to power supply input terminals thereof;

a power amplifier provided away from the switch circuit for supplying the electric power to the switch circuit, the power amplifier including a negative feedback circuit which feedback controls a voltage of the electric power in response to a voltage at the power supply input terminals of the switch circuit;

power supply conductors connecting the power amplifier and the switch circuit for the electric power supply; and signal conductors connecting the power supply input terminals of the switch circuit to the negative feedback circuit to feedback the voltage at the power supply input terminals, the signal conductors forming a feedback loop together with the feedback circuit.

7. The printer head drive system as in claim 6, wherein:

the head includes piezoelectric elements defining the head channels for ink jet operation;

the switch circuit and the head channels are provided in a head unit movably held in the printing apparatus; and the power amplifier is provided fixedly in the printing apparatus.

8. A printer head drive system for a printing apparatus comprising:

a switch circuit for selectively driving head channels when driven by an electric power supplied thereto;

a power amplifier for supplying the electric power to the switch circuit;

power supply conductors connecting the power amplifier and the switch circuit for the electric power supply;

signal conductors connected to detect a voltage applied from the switch circuit to the head channels; and a feedback circuit connected between the signal conductors and the power amplifier for feedback-controlling a voltage of the electric power in response to the detected voltage, the feedback circuit forming a feedback loop together with the switch circuit and the signal conductors.

9. The printer head drive system as in claim 8, wherein:

the head channels and the switch circuit are provided in a head unit movably held in the printing apparatus;

the head channels are connected to the switch circuit and a ground and include one of an inoperative dummy channel and electrical equivalent of one head channel;

the signal conductors are connected to both ends of the one of dummy channel and electrical equivalent; and the power amplifier and the feedback circuit are provided fixedly in the printing apparatus.

10. The printer head drive system as in claim 8, wherein:

the feedback circuit includes an impedance converter connected to the signal conductors; and the head channels include piezoelectric elements for ink jet operation.

11. A printer head drive system for a printing apparatus comprising:

a switch circuit for selectively driving head channels when driven by an electric power supplied thereto, the switch circuit having a nonlinear characteristics;

a power amplifier for supplying the electric power to the switch circuit, the power amplifier including at a final stage thereof output transistors connected in a push-pull circuit and including series circuits of a resistor and a capacitor connected in parallel with respective base resistors of the transistors;

power supply conductors connecting the power amplifier to the switch circuit for the electric power supply; and a negative feedback circuit for compensating a loss caused in the power supply conductors and the nonlinear characteristics of the switch circuit.

12. The printer head drive system as in claim 11, wherein:

the power amplifier includes a voltage amplifying stage having input transistors which are PNP type and NPN type in case of a positive single voltage source and a negative single voltage source, respectively.

13. The printer head drive system as in claim 12, wherein:

the voltage amplifying stage includes one of a constant current source and a current-mirror circuit used as a collector load of the input transistors.

14. The printer head drive system as in claim 11, wherein:

the power amplifier includes a voltage amplifying stage and a current amplifying stage; and the current amplifying stage has a first cut-off frequency higher than a frequency in which an amplification degree of the voltage amplifying stage becomes 0.

15. The printer head drive system as in claim 11, wherein:

the power amplifier includes drive transistors for driving the output transistors, the drive transistors being connected in a push-pull circuit and including series circuits of a resistor and a capacitor connected in parallel with respective base resistors thereof.

16. The printer head drive system as in claim 11, wherein:

the head channels includes piezoelectric elements for ink jet operation.

17. A printer head drive system for a printing apparatus comprising:

a head unit including a plurality of capacitive-type printer heads and a driver circuit for selectively driving the printer heads by an electric power supplied thereto; and a power supply unit including a power amplifier for supplying the electric power to the driver circuit, the power amplifier including at a final stage thereof output transistors connected in a push-pull circuit and including series circuits of a resistor and a capacitor connected in parallel with respective base resistors of the transistors.

18. The printer head drive system as in claim 17, wherein:

the driver circuit includes a normally-on switch;

the printer heads include a capacitive element connected to the normally-on switch for ink jetting operation; and the normally-on switch and the capacitive element are provided in a negative feedback loop for feedback-controlling the voltage applied from the output transistors of the power amplifier.

19. A printer head drive system for a printing apparatus comprising:

a power supply unit held fixedly in the printing apparatus for producing an electric power;

a head unit held in the printing apparatus and including a printer head electrically driven by the electric power;

power supply conductors connecting electrically the power supply unit and the head unit; and a negative feedback loop including a signal conductor for feeding back a voltage of the electric power from the head unit to the power supply unit and thereby regulating a voltage of the electric power produced by the power supply unit.

20. The printer head drive system as in claim 19, wherein:

the head unit is held movably and includes a switch circuit connected to the printer head; and the signal conductor is connected to a junction between the switch circuit and the printer head.

* * * * *